US006656001B2

(12) United States Patent
Ginschel et al.

(10) Patent No.: US 6,656,001 B2
(45) Date of Patent: Dec. 2, 2003

(54) BUSBAR HOLDER

(75) Inventors: Peter Ginschel, Pödeldorf (DE); Christian Suess, Strullendorf (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 09/974,617

(22) Filed: Oct. 9, 2001

(65) Prior Publication Data

US 2002/0127920 A1 Sep. 12, 2002

(30) Foreign Application Priority Data

Oct. 7, 2000 (DE) ..... 100 49 696

(51) Int. Cl.[7] ..... H01R 4/48
(52) U.S. Cl. ..... 439/835
(58) Field of Search ..... 439/709, 715, 439/716, 723, 724, 725, 728, 729, 834, 835, 838

(56) References Cited

FOREIGN PATENT DOCUMENTS

| | | |
|---|---|---|
| DE | 7313261 | 8/1973 |
| DE | 35 10 210 A1 | 10/1986 |
| DE | 40 34 204 A1 | 4/1992 |
| DE | 92 01 410.0 | 5/1992 |
| DE | 93 15 475.5 | 2/1994 |
| DE | 195 31 115 A1 | 2/1997 |
| DE | 197 14 633 C1 | 7/1998 |
| EP | 0 702 427 A2 | 3/1996 |
| EP | 0 743 708 A1 | 11/1996 |
| EP | 0 751 585 A1 | 1/1997 |
| FR | 2 358 757 | 2/1978 |
| GB | 2 013 419 A | 8/1979 |

*Primary Examiner*—Tulsidas Patel
(74) *Attorney, Agent, or Firm*—Laurence A. Greenberg; Werner H. Stemer; Ralph E. Locher

(57) ABSTRACT

A holder for a busbar includes a receiving slot for receiving the busbar and at least one spring-loaded jaw projecting under spring pressure into the receiving slot as a stop for fixing the busbar in the axial direction.

20 Claims, 4 Drawing Sheets

BUSBAR HOLDER

BACKGROUND OF THE INVENTION

FIELD OF THE INVENTION

The invention relates to a holder for busbars. European Patent EP 0 751 585 B discloses an example of a busbar holder for side-by-side terminal blocks, additional busbars, described therein as conductor rails, can also be used. Such busbars serve to make contact with a plurality of contacts. In particular, screw contacts are used to make the contact. An example of a frequent application is the selective bridging of selected side-by-side terminals of a side-by-side terminal block composed of a plurality of side-by-side terminals. In such a case, it is undesirable for the busbar to change its position, in other words, to be displaced, for example, when screw contacts are tightened. What is needed is an improvement for the mechanical retention or mounting of the busbar.

The prior art mountings for busbars have complex structures. In particular, it is frequently necessary to secure the busbar with the aid of a screw securing device or, as in the case of European Patent EP 0 751 585 B, by a mechanical retention device affixed or applied subsequently.

SUMMARY OF THE INVENTION

It is accordingly an object of the invention to provide a busbar holder that overcomes the hereinafore-mentioned disadvantages of the heretofore-known devices of this general type and that forms a holder for a busbar as simply as possible with the busbar holder serving for the mechanical retention or mounting of the busbar.

With the foregoing and other objects in view, there is provided, in accordance with the invention, a busbar holder including a body having a receiving slot for receiving a busbar with a busbar axis, the receiving slot having an interior, and at least one spring-loaded jaw connected to the body and projecting into the interior of the receiving slot, the at least one spring-loaded jaw forming a stop fixing the busbar with respect to the busbar axis when the busbar is inserted in the receiving slot.

In accordance with another feature of the invention, the at least one spring-loaded jaw has a spring part for projecting the at least one spring-loaded jaw into the interior of the receiving slot under pressure.

The invention is based on the idea of providing, on the busbar holder, a receiving slot formed to complement the geometry of the busbar. At least one spring-loaded jaw abutting against a spring member projects into the slot cross-section of the receiving slot. Such a configuration has the advantage that the busbar holder according to the invention can, for its part, be used as a busbar holder positioned at the edge. In such a configuration, the spring-loaded jaw projects into the cross-section of the receiving slot and forms a stop for the busbar, thus canceling the axial displaceability of the busbar. Secondly, however, it is also possible to use the busbar holder according to the invention as an intermediate holder for relatively long busbars. In such a case, the receiving slot encloses the busbar with positive fitting. However, the spring-loaded jaw is simply pressed out of the cross-section of the receiving slot against the spring pressure, so that the spring-loaded jaw no longer projects disruptively into the receiving slot. The receiving slot is, thus, entirely exposed for the busbar to be passed through.

In accordance with an added feature of the invention, the at least one spring-loaded jaw is two spring-loaded jaws, the receiving slot has two edges or sides, and one spring-loaded jaw is disposed at each of the two edges or sides of the receiving slot.

Advantageously, the busbar holder is embodied with one spring-loaded jaw at each of the two ends of the receiving slot. As a result, it is possible to use one and the same busbar holder, in one case, as an edge limiting holder on the right-hand side of the busbar and, in another case, as an edge limiting holder on the left-hand side of the busbar. The spring-loaded jaw that is not needed in each case, and is therefore disruptive, is simply pressed out of the receiving slot, while the other spring-loaded jaw that is needed in the particular case acts as a right-hand or left-hand end stop for the busbar. It is, thus, possible, with a single type of busbar holder, to provide both a right-hand edge-limiting stop and a left-hand edge-limiting stop, and also an intermediate holder interposed between the edge limiting stops. The configuration is simple in terms of production engineering and additionally minimizes the necessary stock keeping in an advantageous manner.

In accordance with a further feature of the invention, the receiving slot has a U-shaped cross-section including two legs and a bottom, the bottom and at least one of the two legs form a constriction, and the at least one spring-loaded jaw is disposed in a region of the constriction.

In accordance with an additional feature of the invention, the receiving slot is disposed lying on one of the legs and horizontally pivoted on the busbar holder.

In accordance with yet another feature of the invention, the receiving slot is horizontally disposed along one of the legs.

Particularly advantageous is the use of the U-shaped cross-section for a receiving slot where the receiving slot is formed in the manner of a receiving mouth. The receiving mouth encloses the busbar, customarily of rectangular cross-section, from three sides, which advantageously favors the guiding and mounting properties of the holder. It is advantageous, moreover, to configure the spring-loaded jaws in the region of the constriction formed by the bottom of the U-shape with each one of the two legs of the U-shape. In such a case, the busbar is already guided in the receiver, with positive fitting and in a flat position, before it enters into engagement with the spring-loaded jaws. Then, it is very easily possible, with the aid of the busbar, to move a spring-loaded jaw standing in the way out of the cross-section of the receiving aperture into its inactive position. Moreover, such spring-loaded jaws are provided with good protection on the busbar holder and are well safeguarded against destruction.

In accordance with yet a further feature of the invention, the at least one spring-loaded jaw projects into the receiving slot from one of the two legs.

In accordance with yet an added feature of the invention, the receiving slot has an end, and the at least one spring-loaded jaw is disposed at the end of the receiving slot.

In accordance with yet an additional feature of the invention, the receiving slot has a bottom, and the at least one spring-loaded jaw projects into the receiving slot from the bottom.

In accordance with again another feature of the invention, the receiving slot has a top, and the at least one spring-loaded jaw projects into the receiving slot from the top.

A configuration of the receiving slot is frequently needed in practice for the fitting of the busbar holder from the front side of the holder. Such a configuration is further developed by having the spring-loaded jaws both project from below into the receiving slot and hang down from above into the receiving slot. Similarly, it is possible to provide a hanging spring-loaded jaw at one end and a projecting spring-loaded jaw at the other end. In a further embodiment, of course, it is also conceivable to provide one projecting and one hanging spring-loaded jaw in pairs at each end of the receiving slot.

To enable the spring-loaded jaws to be moved more easily out of their active position, where they project into the receiving slot, and into their inactive position, where they expose the receiving slot, in accordance with again a further feature of the invention, the spring-loaded jaw has narrow sides with run-up ramps or they are simply chamfered to form run-up ramps. Thus, the surfaces of the run-up ramps form track guides for the edges of the busbars as they run up thereon, so that the busbar edge simply moves whichever spring-loaded jaw or jaws is/are not needed at the time into a respective inactive position as a result of the continued pressing of the busbar into the receiving slot.

It is particularly advantageous for the busbar holder to be injection molded from plastic. In terms of plastic injection molding technology, in accordance with again an added feature of the invention, it is easy simply to mold the spring-loaded jaws on spring arms, which, in turn, are connected to the housing.

To secure the busbar in its final installed position in the busbar holder, in accordance with again an additional feature of the invention, a pivotable retaining projection is mounted in front of the receiving slot for fixing the busbar therein. Advantageously, a pocket is molded into the receiving projection to receive a screwdriver blade. With the aid of the screwdriver blade, it is easily possible to manipulate the retaining projection, in particular to open the receiving slot for the busbar to be pushed in or out.

In accordance with a concomitant feature of the invention, the body has a mounting arm, and the retaining projection is moveably connected to the body through the mounting arm acting as a pivot spring such that the retaining projection can be moved to fully expose the slot aperture.

Other features that are considered as characteristic for the invention are set forth in the appended claims.

Although the invention is illustrated and described herein as embodied in a busbar holder, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
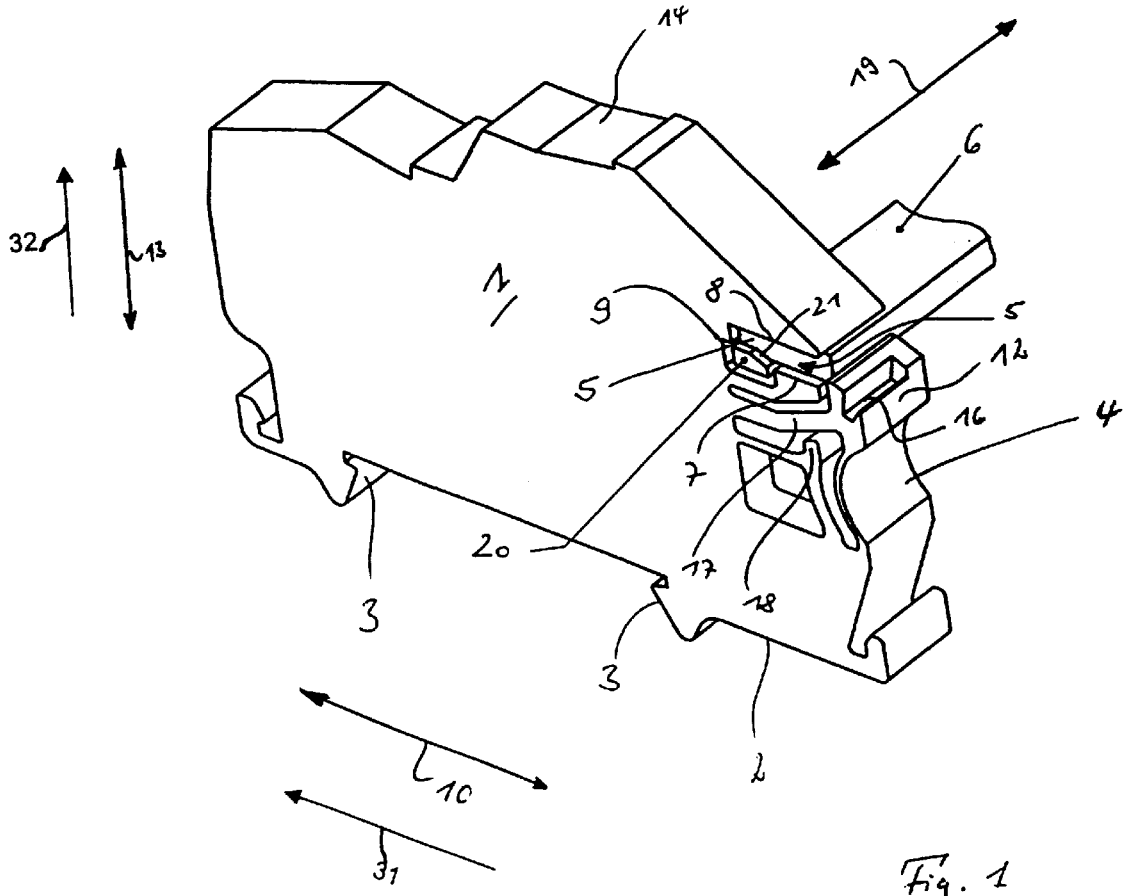
FIG. 1 is a perspective view of a busbar holder according to the invention disposed on the left-hand side relative to the busbar.

Referring now to the figures of the drawings in detail and first, particularly to FIG. 1 thereof, there is shown a busbar holder 1 having latching elements 3 on an underside 2 for fixing the holder 1 upon a non-illustrated carrier rail. The U-shaped receiving slot 5 is molded into the front side 4 of the busbar holder 1. The busbar 6 lies in the receiving slot 5. The receiving slot 5 has a recognizable U-shaped form. The receiving slot 5 is disposed to lie such that one leg 7 of its U-shape forms the bottom of the receiving slot while the other leg 8 of the U-shape forms the top of the slot. The legs 7, 8 of the U-shape are connected by the bottom of the U-shape, forming the back 9 of the slot. The slot aperture 11 (see FIG. 2) lies opposite the back 9 of the U-shape along a busbar 6 insertion axis 10. The direction defined from the slot aperture 11 to the back 9 of the U-shape is referred to as the insertion direction 31. It is particularly apparent from the FIG. 2 that the receiving slot 5 is molded into the front 4 of the busbar holder 1 in the manner of a receiving mouth for the busbar.

Figure 2:
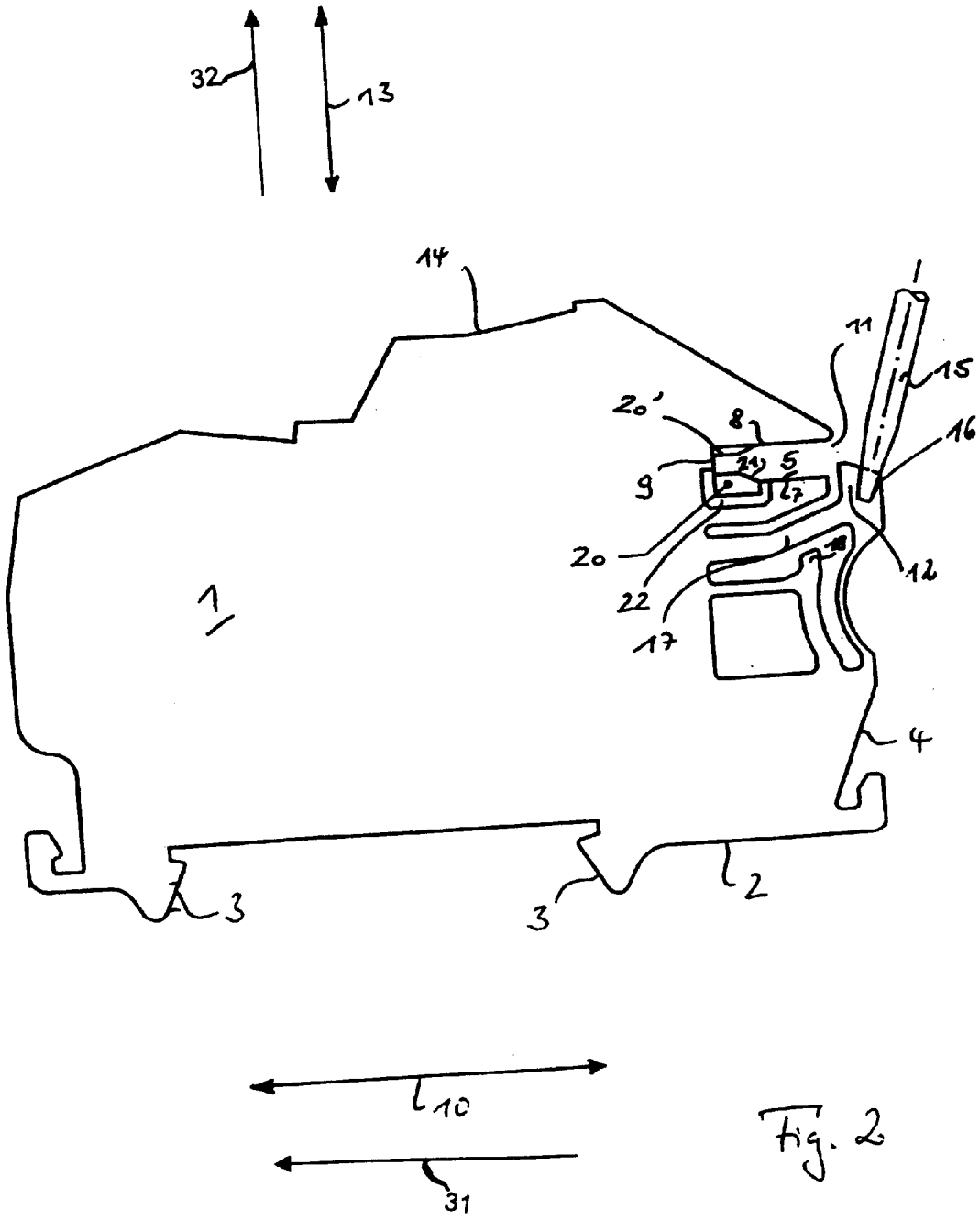
FIG. 2 is a side elevational view of the busbar holder of FIG. 1.

Also recognizable in FIG. 2 is the retaining projection 12 mounted in front of the receiving slot 5, or upstream of the slot 5 with respect to the insertion direction 31. The retaining projection 12 projects into the receiving slot 5 along a locking axis 13 in what is referred to as a locking direction 32. The axis 13 extends perpendicular to the insertion axis 10. The front 4 of the busbar holder 1 also extends in the locking direction 32 from the bottom 2 toward the top 14.

In order to introduce the busbar 6 into the receiving slot 5, the screwdriver blade 15 illustrated in FIG. 2 is introduced into the receiving pocket 16 molded into the retaining projection 12. With the aid of the screwdriver blade 15, the retaining projection 12 is pressed downward or opposite the locking direction 32 toward the underside 2 of the busbar holder 1, until the projection mounting arm 17 comes into contact with the travel limiting projection 18. The busbar 6 is, then, pushed in the insertion direction 31 into the receiving slot 5, which is now exposed. The spring-loaded jaw 20 is biased into the receiving slot 5 in the locking direction 32 to fix the busbar 6 with respect to a busbar axis 19, which extends perpendicular to both to the locking axis 13 and to the insertion axis 10.

The run-up ramp 21 is formed on the spring-loaded jaw 20. The run-up ramp 21 takes effect when the busbar 6 engages over the receiving slot 5 when moving in the insertion direction 31, in other words, when it is guided through the receiving slot 5. In such a case, the rear lower edge of the busbar 6 in the busbar's final installed state slides up on the run-up ramp 21 and moves the spring-loaded jaw 20 into its inactive (lowered) position. An escape space 22 is molded into the busbar holder 1 below the spring-loaded jaw 20 for permitting the spring-loaded jaw 20 to move into its inactive position.

It is apparent from FIG. 1 that the spring-loaded jaw 20 eliminates the displaceability of the busbar 6 in the locking direction 19. Based on the illustration of FIG. 1, the busbar 6 is, consequently, secured against axial displacement on its left-hand side by the busbar holder 1.

Figure 3:
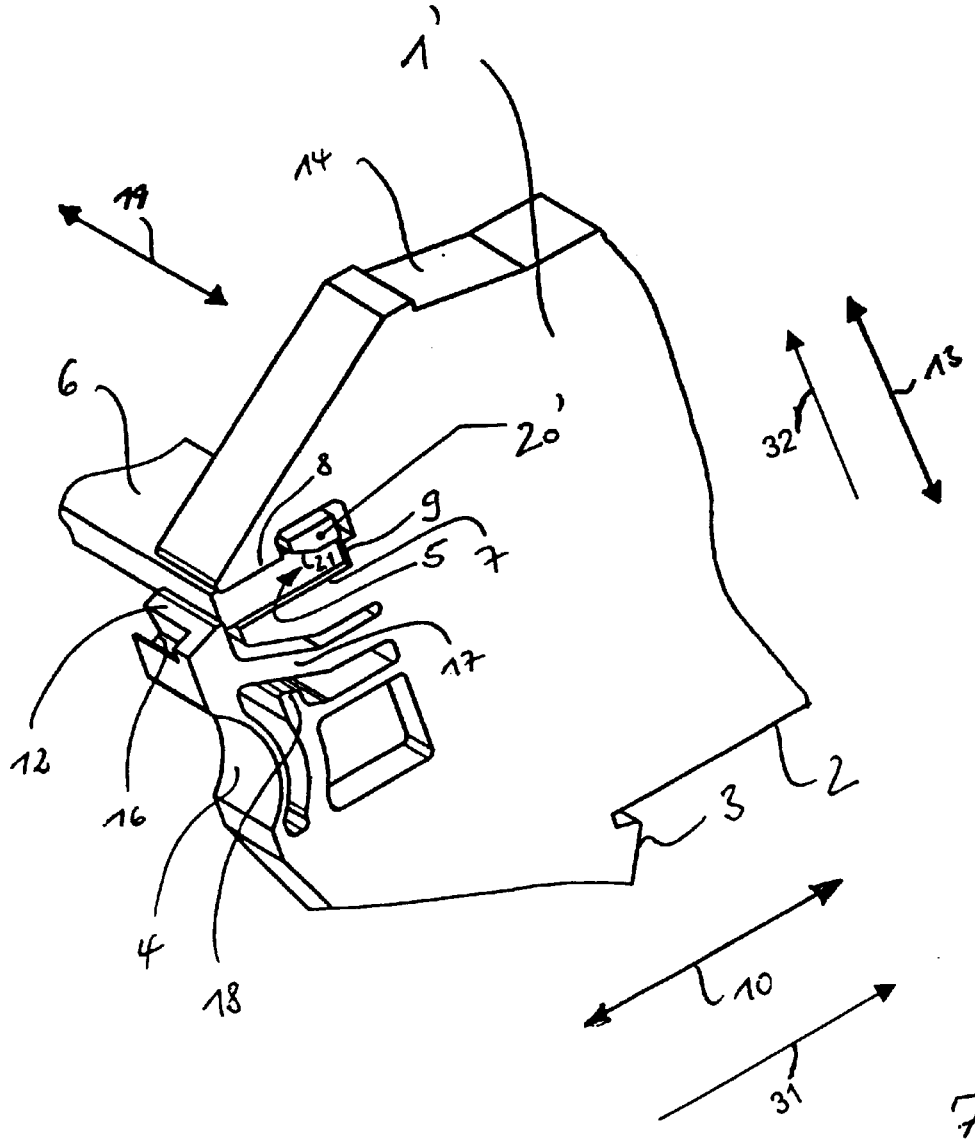
FIG. 3 is a fragmentary perspective view of the busbar holder of FIG. 1 viewed from the right-hand side relative to the busbar.

FIG. 3 illustrates a busbar holder 1' formed analogously to the busbar holder 1 in FIG. 1. The busbar holder 1', in turn, has latching elements 3 on its underside 2 for latching onto a non-illustrated carrier rail. The other parts described in connection with FIGS. 1 and 2 are identical in form to those in the case of the busbar holder 1' illustrated in FIG. 3, which is indicated by the allocation of the same reference numerals.

In the case of the left-hand busbar holder 1 in the example embodiment of FIGS. 1 and 2, the spring-loaded jaw 20 is disposed in the constriction formed by the lower leg 7 of the U-shape closer to the underside 2 of the busbar holder 1 and the back 9 of the U-shape so that the spring-loaded jaw 20 projects from below into the receiving slot 5.

Figure 4:
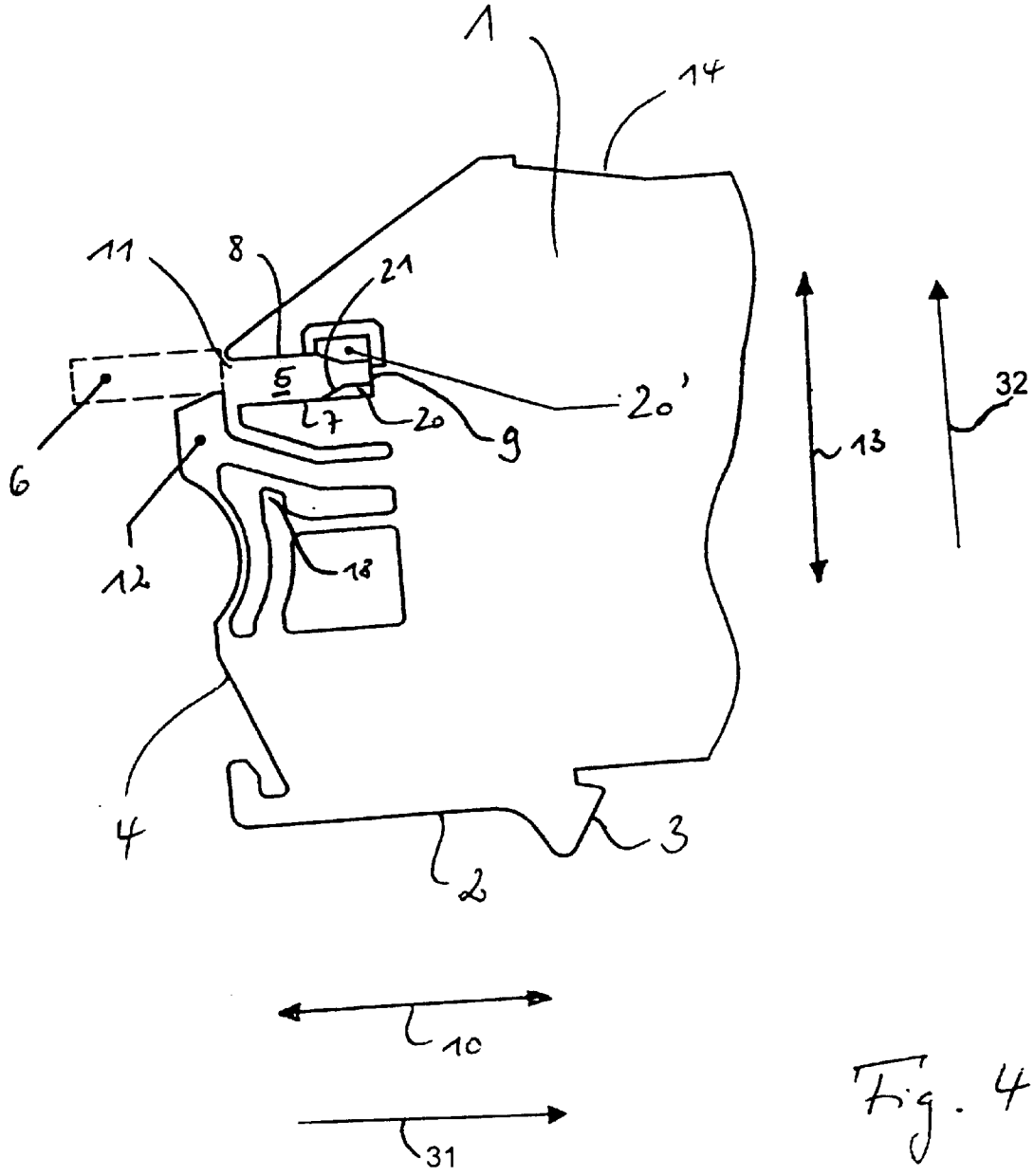
FIG. 4 is a fragmentary, side elevational view of the busbar holder of FIG. 3.

In comparison, the spring-loaded jaw 20' in the embodiment illustrated in FIGS. 3 and 4 is disposed in the constriction formed by the upper leg 8 of the U-shape and the back 9 of the U-shape. Consequently, in the example of the busbar holder 1' disposed on the right (FIGS. 3 and 4), the spring-loaded jaw 20' hangs down from above into the receiving slot 5 of the busbar holder 1'. It is also possible on such a busbar holder 1, 1' to couple a spring-loaded jaw 20 projecting into the receiving slot 5 from the underside, on one hand, and a spring-loaded jaw 20' projecting into the receiving slot 5 from above, on the other hand. The embodiment has the advantage that the spring-loaded arms for mounting the spring-loaded jaws 20, 20' have an especially long shape so that they produce a particularly good lever effect.

In the illustration of FIG. 4, it can be seen that the busbar 6 (illustrated by broken lines) can be pushed into the receiving slot 5 in the insertion direction 31 after the retaining projection 12 has been depressed (i.e., opposite the locking direction 32) by the screwdriver blade 15. In such a case, the spring-loaded jaw 20' projecting from above, in other words, disposed on the right in the final state of installation, will project into the receiving slot 5 against the locking direction 32 to be able to exert its locking effect along the locking axis 13 and busbar axis 19. With its rear under edge, however, the busbar 6 will impact the run-up ramp 21 of the spring-loaded jaw 20 and press the latter downward into its escape space 22 and into its inactive position. Thus, in the case of the busbar holder 1' shown in FIGS. 3 and 4, in the final installed state, the right-hand spring-loaded jaw 20' hanging down from above prevents, in its active position, the axial displaceability of the busbar 6. Precisely the reverse is the case in the example of the embodiment illustrated in FIGS. 1 and 2, where the spring-loaded jaw 20 projecting into the receiving slot 5 from below is in its active position, while the spring-loaded jaw 20' projecting from above into the receiving slot 5 has been moved into its inactive position.

We claim:

1. A busbar holder, comprising:

a body having a receiving slot for receiving a busbar with a busbar axis, said receiving slot having an interior; and at least one spring-loaded jaw connected to said body and projecting into said interior of said receiving slot, said at least one spring-loaded jaw formed with a stop for fixing the busbar with respect to the busbar axis when the busbar is inserted in paid receiving slot.

2. The busbar holder according to claim 1, wherein said at least one spring-loaded jaw has a spring part for projecting said at least one spring-loaded jaw into said interior of said receiving slot under pressure.

3. The busbar holder according to claim 1, wherein:

said at least one spring-loaded jaw is two spring-loaded jaws;

said receiving slot Ms two edges; and one spring-loaded jaw is disposed at each of said two edges of said receiving slot.

4. The busbar holder according to claim 1, wherein:

said at least one spring-loaded jaw is two spring-loaded jaws;

said receiving slot has two sides; and one spring-loaded jaw is disposed at each of said two sides of said receiving slot.

5. The busbar holder according to claim 1, wherein:

said receiving slot has a U-shaped cross-section including two legs and a bottom;

said bottom and at least one of said two legs form a constriction; and said at least one spring-loaded jaw is disposed in a region of said constriction.

6. The busbar holder according to claim 5, wherein said receiving slot is disposed lying on one of said legs and is horizontally located on the busbar holder.

7. The busbar holder according to claim 5, wherein said receiving slot is horizontally disposed along one of said legs.

8. The busbar holder according to claim 7, wherein said at least one spring-loaded jaw projects into said receiving slot from one of said two legs.

9. The busbar holder according to claim 8, wherein:

said receiving slot has an end; and said at least one spring-loaded jaw is disposed at said end of said receiving slot.

10. The busbar holder according to claim. 5, wherein said at least one spring-loaded jaw projects into said receiving slot from one of said two legs.

11. The busbar holder according to claim 10, wherein:

said receiving slot has an end; and said at least one spring-loaded jaw is disposed at said end of said receiving slot.

12. The busbar holder according to claim 1, wherein:

said receiving slot has a bottom; and said at least one spring-loaded jaw projects into said receiving slot from said bottom.

13. The busbar holder according to claim 12, wherein:

said receiving slot has an end; and said at least one spring-loaded jaw is disposed at said end of said receiving slot.

14. The busbar holder according to claim 1, wherein:

said receiving slot has a top; and said at least one spring-loaded jaw projects into said receiving slot from said top.

15. The busbar holder according to claim 14, wherein:

said receiving slot has an end; and said at least one spring-loaded jaw is disposed at said end of said receiving slot.

16. The busbar holder according to claim 1, wherein said at least one spring-loaded jaw has a run-up ramp.

17. The busbar holder according to claim 1, wherein said at least one spring-loaded jaw has:

a narrowed end; and a run-up ramp disposed on said narrowed end.

18. The busbar holder according to claim 1, wherein:

said body has at least one spring-loaded arm; and said at least one spring-loaded jaw is disposed on said at least one spring-loaded arm.

19. The busbar holder according to claim 1, wherein:

said receiving slot has a slot aperture and receives a busbar in an insertion direction; and a retaining projection is connected to said body and is disposed in front of said slot aperture upstream with respect to said insertion direction for fixing the busbar in said receiving slot.

20. The busbar holder according to claim 19, wherein:

said body has a mounting arm;

said retaining projection is moveably connected to said body through said mounting arm acting as a pivot spring such that said retaining projection can be moved to fully expose said slot aperture.

* * * * *